US006941616B2

(12) United States Patent
Roy

(10) Patent No.: US 6,941,616 B2
(45) Date of Patent: Sep. 13, 2005

(54) PINLESS HINGE

(75) Inventor: Armand E. Roy, Attleboro, MA (US)

(73) Assignee: Craft, Inc., South Attleboro, MA (US)

( * ) Notice: Subject to any disclaimer, the term of this patent is extended or adjusted under 35 U.S.C. 154(b) by 0 days.

(21) Appl. No.: 10/850,541

(22) Filed: May 20, 2004

(65) Prior Publication Data

US 2005/0034273 A1 Feb. 17, 2005

Related U.S. Application Data

(60) Provisional application No. 60/494,243, filed on Aug. 11, 2003.

(51) Int. Cl.[7] ..... E05D 7/10; E05D 1/04

(52) U.S. Cl. ..... 16/254; 16/355; 16/382; 16/388; 16/384

(58) Field of Search ..... 16/254, 388, 384, 16/382, 355, 342; 248/456, 460, 458, 459, 496; 40/748–750, 754, 755; 29/11; D8/323, 327–329

(56) References Cited

U.S. PATENT DOCUMENTS

| | | | | | |
|---|---|---|---|---|---|
| 880,757 | A | | 3/1908 | Rugg | 16/178 |
| 972,090 | A | | 10/1910 | Ault | 16/270 |
| 1,009,500 | A | | 11/1911 | Glathart | 16/270 |
| 1,047,148 | A | | 12/1912 | Barcus | 16/270 |
| 1,286,694 | A | | 12/1918 | MacDonald | 16/270 |
| 1,433,095 | A | | 10/1922 | Peary | 16/270 |
| 1,566,236 | A | | 12/1925 | Skurdal | 16/178 |
| 1,569,619 | A | | 1/1926 | Cranzler | 16/376 |
| 1,593,929 | A | | 7/1926 | Carrier | 16/374 |
| 1,863,323 | A | | 6/1932 | Berne | 16/256 |
| 1,893,592 | A | | 1/1933 | Newman | 16/178 |
| 2,211,581 | A | | 8/1940 | Ross | 16/364 |
| 2,571,633 | A | | 10/1951 | Vogel | 16/388 |
| 2,811,741 | A | * | 11/1957 | Miller et al. | 16/376 |
| 2,825,917 | A | | 3/1958 | Scinta | 15/250.32 |
| 2,857,618 | A | | 10/1958 | Jordan | 16/191 |
| 3,080,603 | A | * | 3/1963 | Spiselman | 16/355 |
| 3,121,946 | A | * | 2/1964 | Young | 29/434 |
| 3,131,659 | A | | 5/1964 | Idomoto | 112/260 |
| 3,181,197 | A | | 5/1965 | Sperber | 16/274 |
| 3,483,587 | A | * | 12/1969 | McCauley | 16/384 |
| 3,994,045 | A | * | 11/1976 | Roy | 16/355 |
| 4,050,117 | A | * | 9/1977 | Roy | 16/355 |
| 4,063,330 | A | | 12/1977 | Triplette | 16/142 |
| 4,120,074 | A | * | 10/1978 | Haber | 16/257 |
| 4,123,822 | A | * | 11/1978 | Bentley | 16/355 |
| 4,199,126 | A | | 4/1980 | Komendowski | 248/463 |
| 4,349,942 | A | * | 9/1982 | Roy | 16/376 |
| 4,407,044 | A | | 10/1983 | Iseki | 16/237 |
| 4,515,338 | A | * | 5/1985 | Schneider | 248/460 |
| 4,724,580 | A | * | 2/1988 | Paskerian | 16/386 |
| 4,850,082 | A | * | 7/1989 | Yi | 16/341 |
| 4,979,266 | A | * | 12/1990 | Roy | 16/376 |
| 5,361,455 | A | | 11/1994 | Kiefer | 16/235 |
| 5,371,989 | A | * | 12/1994 | Lehnert et al. | 52/309.17 |
| 5,455,989 | A | * | 10/1995 | Roy | 16/376 |

FOREIGN PATENT DOCUMENTS

| | | | | | |
|---|---|---|---|---|---|
| FR | 2644049 | A | * | 9/1990 | A47G/1/14 |

* cited by examiner

*Primary Examiner*—Chuck Y. Mah

(74) *Attorney, Agent, or Firm*—Barlow, Josephs & Holmes, Ltd.

(57) ABSTRACT

The improved pinless hinge assembly (24) includes a first hinge plate (28) having a curled edge (28*a*) defining a center roll having a longitudinal axis (P) with an aperture (42) in the first hinge plate (28). A second hinge plate (30) having a free edge (30*a*) curled about the center roll. A locking lug (40) extends from the free edge (30*a*) of the second hinge (30) and is routed first through the first aperture (42) in the first hinge plate (28) and then through the second aperture (44) in the second hinge plate (30). The locking lug (40) is engaged in a seat (46) in the second hinge plate (30) to maintain the free edge (30*a*) of the second hinge plate (30) curled about the center roll when the first hinge plate (28) rotates relative to the second hinge plate (30) about the longitudinal axis (P). A pair of locking lugs (40) may be also be used. Fasteners (26*a*, 26*b*), such as rosettes, may be respectively employed to connect the first hinge plate (28) to a picture frame strut (18) and to connect the second hinge plate (30) to a picture frame back (20).

19 Claims, 18 Drawing Sheets

PINLESS HINGE

CROSS-REFERENCE TO RELATED APPLICATION

This application claims the benefit of U.S. Provisional Patent Application Ser. No. 60/494,243, filed Aug. 11, 2003.

BACKGROUND OF THE INVENTION

The present invention relates generally to hardware used to rotatably connect two members together. More specifically, the present invention relates to hinge hardware used to rotatably attach a strut to a picture frame. In addition, the present invention relates to an improved pinless hinge assembly that is lighter in weight than prior art pinless hinges while being as strong as such prior art pinless hinges.

It is well known in the art to use a hinge to rotatably attach one member to another, such as a door to a door frame or a picture frame strut to a picture frame back. Typically, the hinge includes two plates which are rotatably connected to one another by a pin. The plates are respectively connected to the two members by some type of fastener, such as threaded fastener, nail or rivet. In the environment of picture frames, rosette fasteners are commonly employed for this purpose.

In the industry of hinges and the structures that use them, pinless hinges are very common. Such a pinless hinge is shown in U.S. Pat. No. 3,994,045 for use as picture frame strut hinge to hingedly connected a picture frame strut to a picture frame back. The free ends of two hinge halves are rolled together to form a pivot point thereby obviating the need for a pin routed through eyelets in the hinge halves. This simplifies and greatly automates the manufacturing process to reduce the costs associated with manufacturing.

The aforesaid pinless hinge construction has particular application as an easel hinge for a picture frame. By way of example and ease of illustration, this environment will be described in connection with such picture frame environment, as will the description of the present invention. It should be understood that the present invention relates to any environment that employs a hinge construction.

Turning now to the picture frame industry, by way of example, a typical picture frame assembly includes a back member, which is usually made of cardboard, medium density fiberboard (MDF), or the like, which fits into a rear seat in a frame molding which can be made of wood, plastic, metal, or the like. A number of turn buttons are commonly attached to the rear side of the molding and pivot into place over the periphery of the back member to secure it in place. A piece of glass, clear plastic, or the like, is positioned between the back member and the molding. A picture, to be displayed, is positioned between the back member and glass.

A picture frame may be mounted for display in several different ways. For example, a hanger or wire may be affixed to the rear side of the frame molding for hanging the frame on a wall for display. Also, a strut is typically employed when the picture frame is to be displayed on a surface, such as a desk or shelf. This strut is hingedly connected to the picture frame back. The strut is commonly shipped in with its strut member in a collapsed condition where it rests flush against the rear side of the picture frame back and frame molding. For the display of a picture frame, the strut member is opened via the hinge and the picture frame is then set on the surface with the bottom of the frame molding and free end of the strut, which is typically flat, in contact with the support surface. Thus, the picture frame is displayed in easel-like fashion for viewing.

Picture frame hardware, such as easel hinges, are typically shipped from its manufacturer to the manufacturer of the picture frame itself for assembly and further sale to a retailer. Easel hinges are made of metal, such as steel, and are shipped by the hundreds. The weight of such hinges significantly adds to the costs of shipping the easel hinges to the frame manufacturers particularly when the parts are being shipped over long distances. Also, the surfaces of these easel hinges are prepared in some way, such as by painting, blackening and oxide coating, and the like. Such paint and chemicals further add to the cost of such hinges.

As stated above, prior art pinless hinges require that the free ends of the two plate halves of the hinge be rolled together to form the pivoting joint. This requires that the steel be strong enough to maintain this rolled pivot connection. For example, these prior art pinless hinges are made from steel stock in the range of 0.025 inches which has been known to be thick enough so that the integrity of the pinless hinge is maintained after stamping, installation and during use. While these pinless hinges obviate the need for a pin to form the pivot connection, they suffer from the disadvantage of requiring relatively heavy stock to maintain the integrity of the hinge and the pinless joint construction.

There have been attempts in the prior art to reduce the weight of pinless easel hinges. For example, thinner steel stock has been used in the prior art for the manufacture of the hinge to reduce the weight. However, if the steel stock is too thin, the rolled pivot connection of the pinless hinge separates over time thereby jeopardizing the integrity of the hinge pivot connection. Also, it is possible to manufacture a smaller overall hinge. However, this is not an option with larger frames that require a certain sized easel hinge in order for the strut to work properly to display the frame. Also, attempts have been made to cut out portions of the hinge plate to reduce weight. However, further cut-outs increases stamping time and impacts the integrity of the hinge.

In view of the foregoing, there is a demand for a picture frame easel hinge to be lighter in weight than prior art pinless hinges of the same dimensions for use with the same sized picture frames. There is a desire to use less metal to reduce the cost of manufacture of the hinge. There is a demand for a hinge that is lighter and smaller that prior art hinges so that more hinges can fit into a shipping box. There is a demand for an easel hinge that enables shipping costs to be reduced per hinge which is particularly important when millions of hinges are manufactured, shipped and sold.

SUMMARY OF THE INVENTION

The present invention preserves the advantages of prior art hinge constructions and related hardware including picture frame easel hinges. In addition, it provides new advantages not found in currently available hinges and overcomes many disadvantages of such currently available hinges and related assemblies.

The invention is generally directed to a new and novel hinge that has particular application in the connection of picture frame members together, namely, a strut to a picture frame back. The pinless picture frame hinge of the present invention provides an improved pinless hinge for hingedly connecting a first member to a second member.

The improved pinless hinge assembly includes a first hinge plate having a curled edge defining a center roll having a longitudinal axis with an aperture in the first hinge plate. A second hinge plate having a free edge curled about the center roll. A locking lug extends from the free edge of the second hinge and is routed first through the first aperture in the first hinge plate and then through the second aperture in the second hinge plate. The locking lug is engaged in a seat in the second hinge plate to maintain the free edge of the second hinge plate curled about the center roll when the first hinge plate rotates relative to the second hinge plate about the longitudinal axis. A pair of locking lugs may be used to improved containment of the center roll. Fasteners, such as rosettes, may be respectively employed to connect the first hinge plate to a picture frame strut and to connect the second hinge to a picture frame back. Such rosettes are particularly well-suited for connecting to medium density fiberboard (MDF) which is commonly used in the industry. The improved easel hinge of the present invention can be manufactured using conventional progressive tooling.

The use of the locking lugs or straps enables a thinner stock to be used which is, for example, in the 0.022 inch range compared to, for example, 0.025 inch stock used in prior art hinges. This is approximately a 10% savings in weight which translates into a smaller, lighter hinge that uses less metal and is, as a result, less expensive to manufacture. Also, since the hinge is smaller than prior art hinges, more hinges can fit into a given size shipping container. The lighter weight reduces shipping cost per hinge. Even a small weight and size savings due to the present design is a vast improvement over prior art hinges which will have a large monetary impact, particularly when millions of hinges are manufactured, shipped and sold.

It is therefore an object of the present invention to provide a pinless hinge that can be easily manufactured using known manufacturing techniques, such as metal stamping and use of progressive tooling. It is an object of the invention to provide an improved pinless easel hinge that is lighter in weight than prior art hinges. It is also an object of the present invention to provide an improved pinless easel hinge that can be smaller yet just as strong as larger easel hinges. Another object of the present invention is to provide an improved pinless easel hinge that is less expensive, per hinge, to manufacture and ship. A further object of the present invention is to provide an improved pinless easel hinge that is lighter in weight than prior hinges yet performs the same without sacrificing aesthetic appearance.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1A:
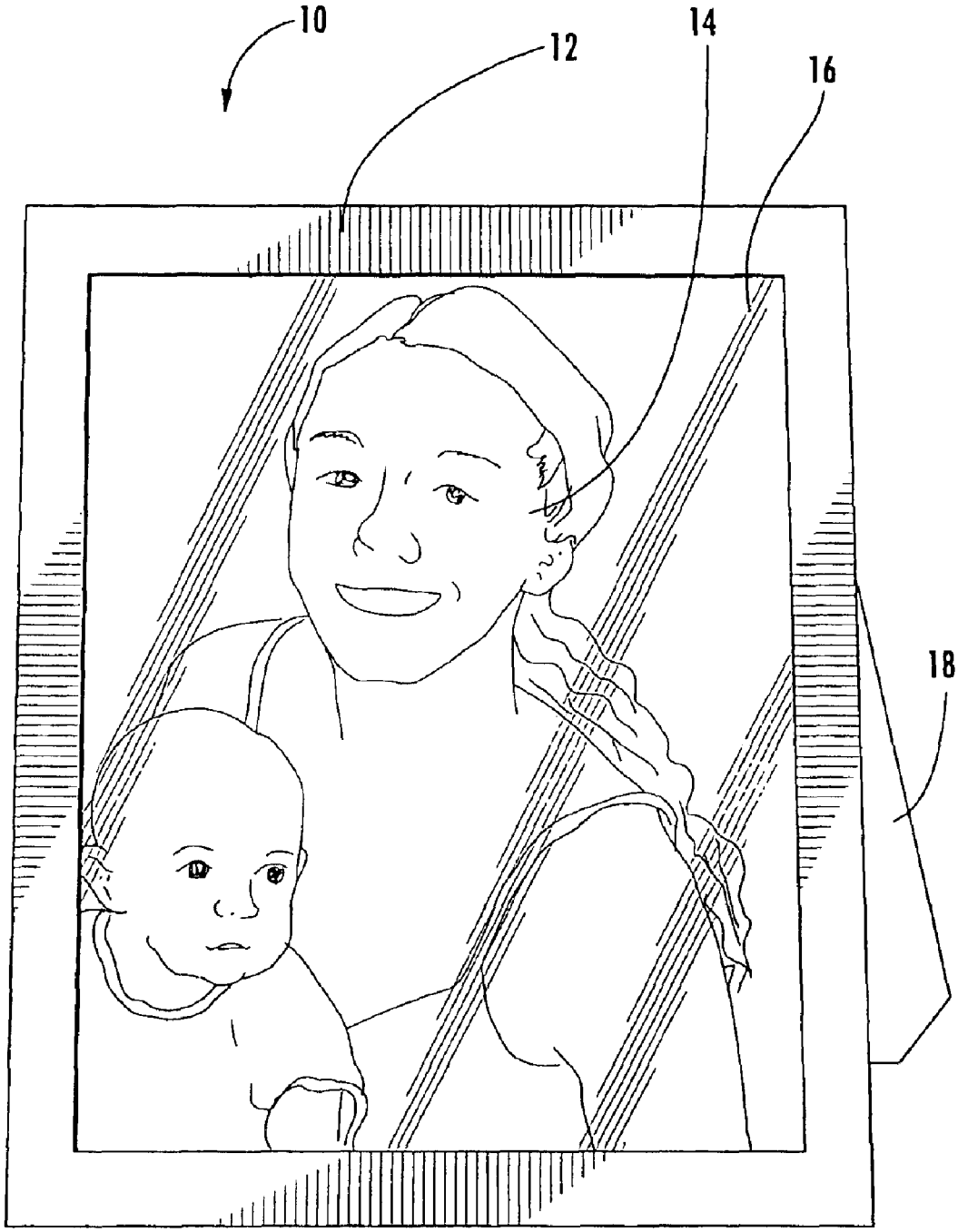
FIG. 1A is a perspective view of the front of a picture frame being held in an upright position by a picture frame strut.

Referring first to FIG. 1A, a front perspective view of a picture frame assembly 10 is shown. A outer frame molding 12 is provided with a photograph or artwork 14 residing behind a transparent plate 16, such as glass or Plexiglas. The frame molding 12 can be made of wood, ceramic, and the like. A strut 18 is employed to prop up the frame molding 12 into a substantially upright position. Picture frame struts 18 are also typically made of cardboard but could be made of other materials, such as wood. This general structure is well known in the art.

Figure 1B:
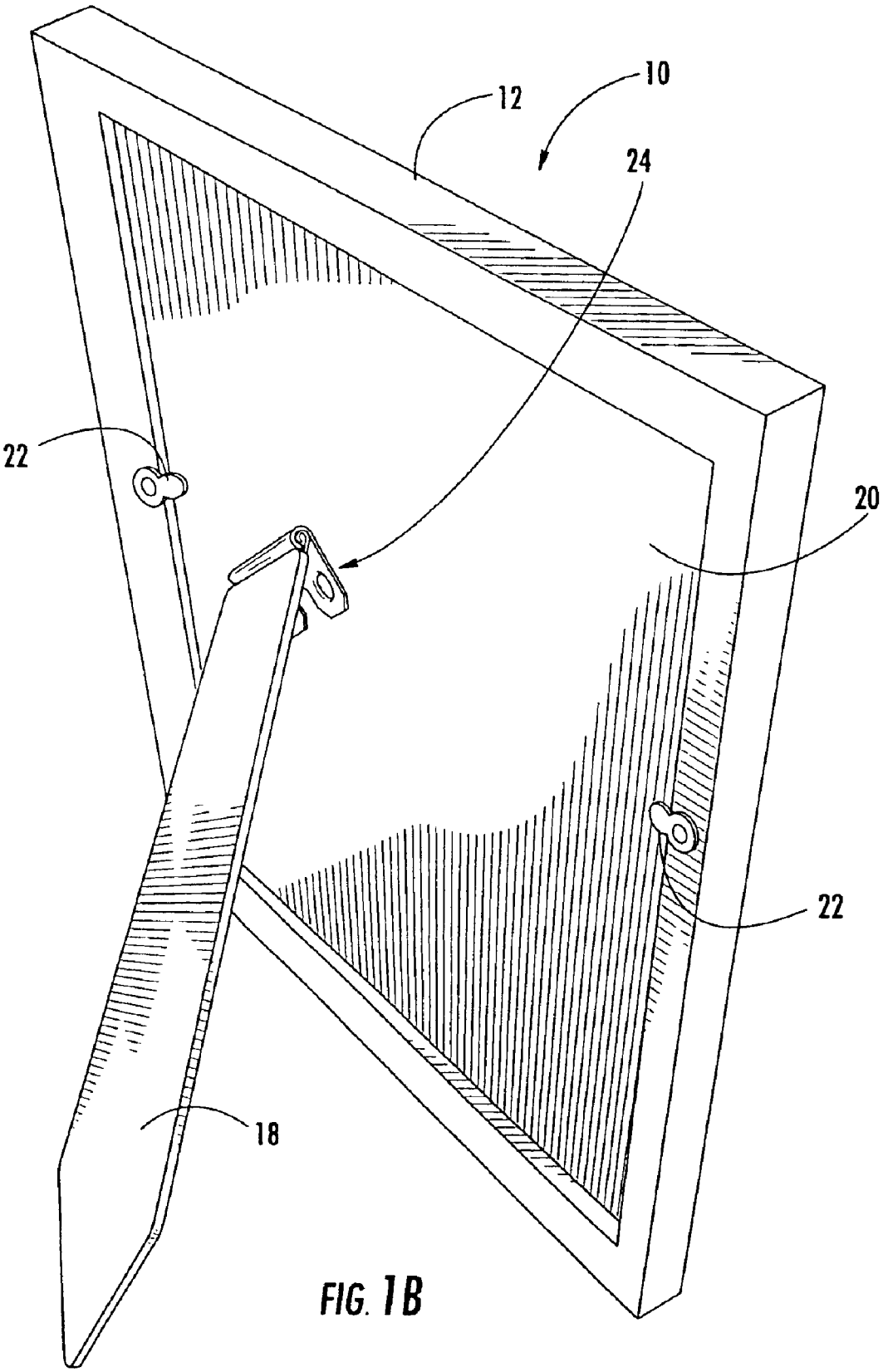
FIG. 1B is a perspective view of the back of a picture frame with a strut hingedly connected thereto by the hinge of the present invention with the strut in an opened position.

FIG. 1B illustrates a rear perspective view of the picture frame assembly 10 that is generally known in the art. The photograph 14 and transparent plate 16 (shown in FIG. 1A) is sandwiched between a picture frame back 20, preferably made of cardboard, and the frame molding 12 as is well known in the art. Turn buttons 22 are provided to maintain the picture frame back 20 within the frame molding 12 and the photograph 14 sandwiched therebetween. The picture frame strut 18 is hingedly connected to a picture frame back 20 by an easel hinge 24. Typically, the hinge 24 and turn buttons 22 are preferably made of metal but could be made of other materials as well.

Figure 1C:
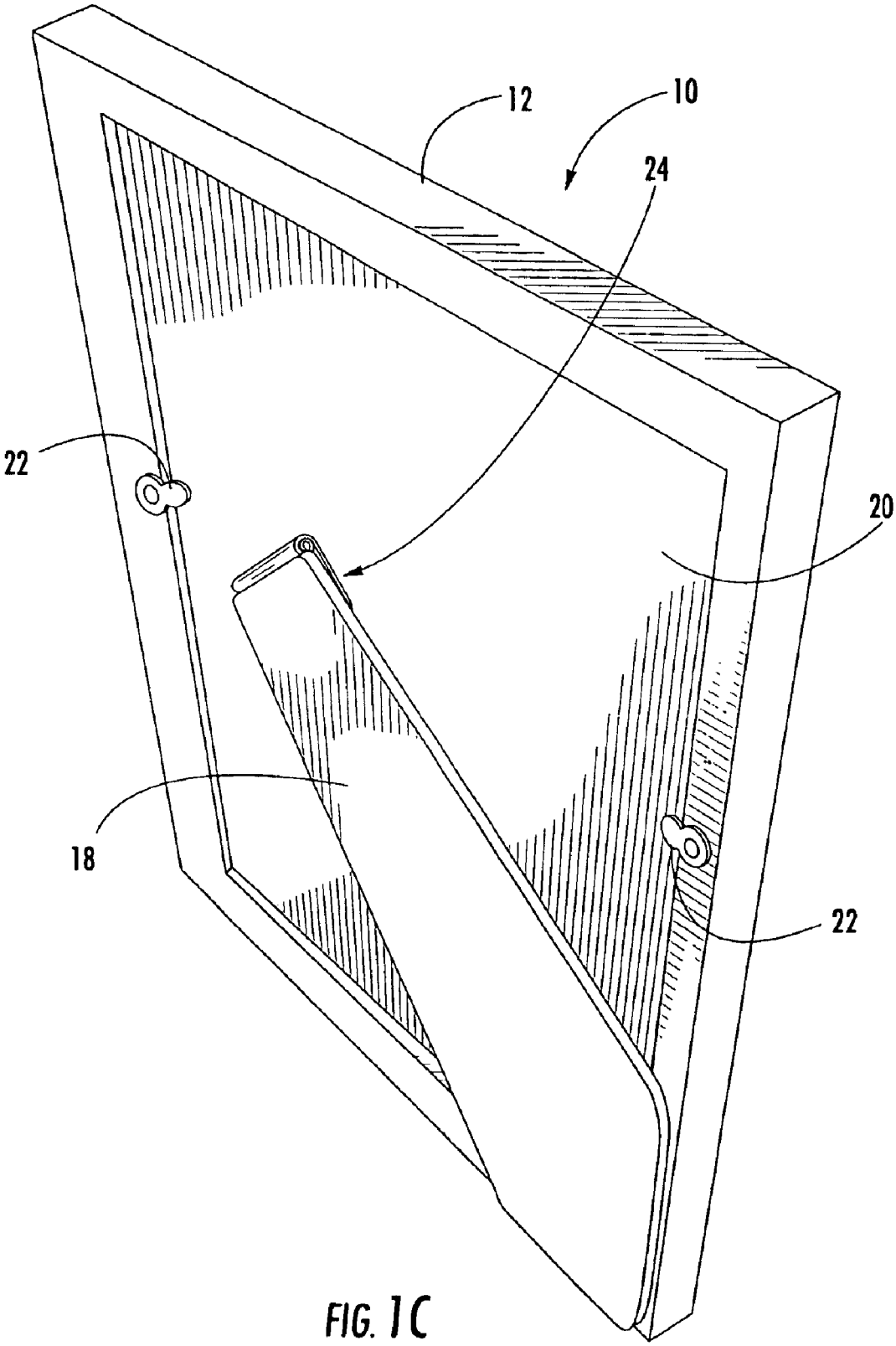
FIG. 1C is a perspective view of the back of a picture frame with a strut hingedly connected thereto by the hinge of the present invention with the strut in a closed position.

Hinge 24 is of a unique construction in accordance with the present invention. However, FIGS. 1A, 1B and 1C illustrate a picture frame assembly 10 that employs the improved pinless hinge 24 of the present invention. FIG. 1B shows the strut 18 in an opened position while FIG. 1C shows the strut 18 in a closed position against the back 20 of the picture frame assembly 10. As will be described in detail below, the hinge 24 of the present invention includes a unique improved structure for an easel hinge of the pinless type.

Figure 2:
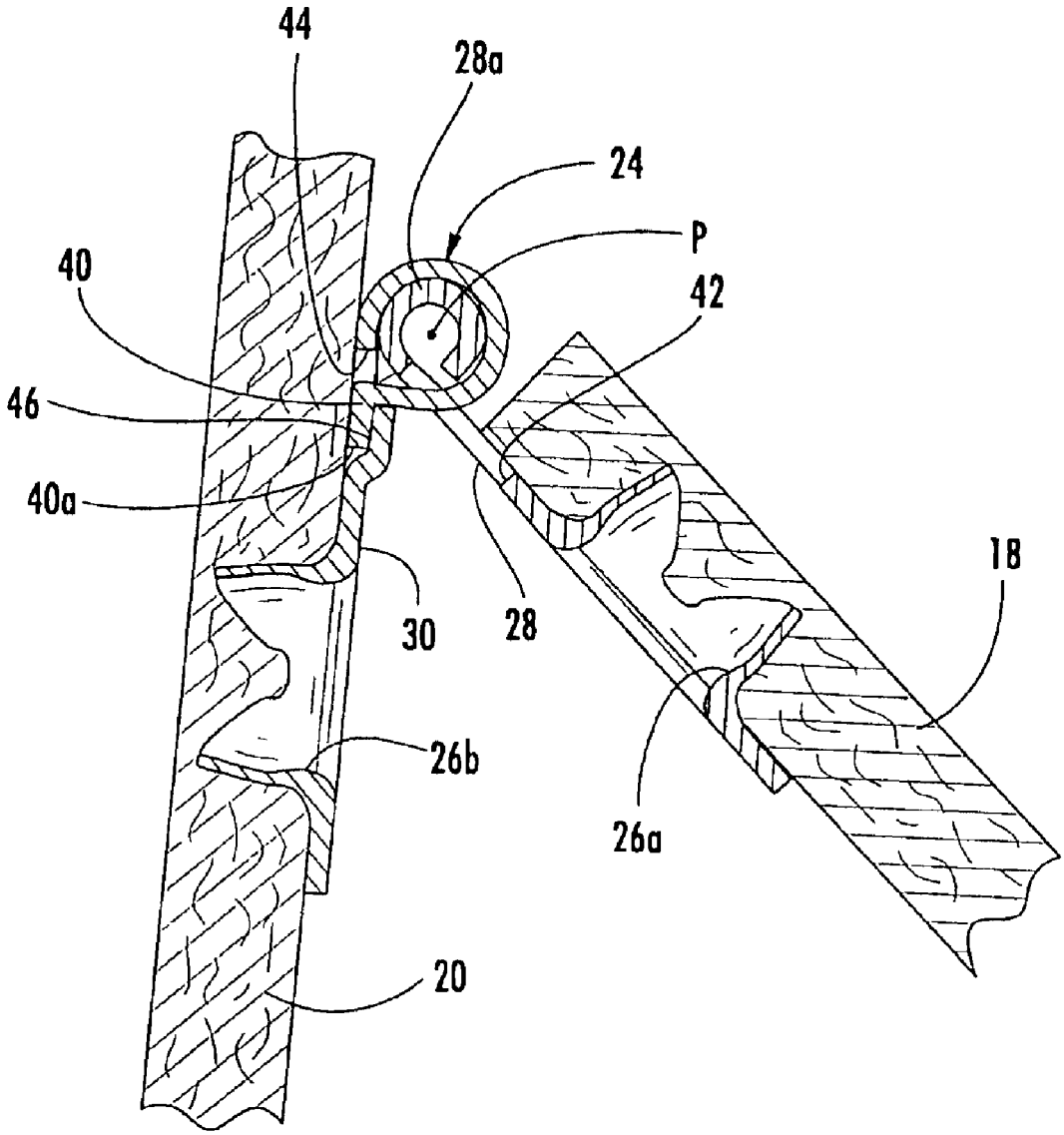
FIG. 2 cross-sectional view through the line 12—12 of FIG. 7 with the hinge open and attached to a strut and picture frame back as shown in FIG. 1B.

FIG. 2 illustrates a cross-sectional view of the hinge 24 of the present invention hingedly connecting a strut 18 to a picture frame back 20. In FIG. 2, the hinge 24 is preferably connected to the back 20 and the strut 18 by rosette type fasteners 26*a* and 26*b* which greatly facilitates connection of the preferably metal hinge 24 to the cardboard strut 18 and picture frame back 20. If other materials are used, different fastening structures can be used and still be within the scope of the present invention.

The picture frame strut 18 is connected to a first hinge plate 28 and the picture frame back 20 is connected to a second hinge plate 30. The first hinge plate 28 and the second hinge plate 30 are rotatably connected to one another along a pivot axis "P". FIG. 2 shows the pivot connection to be a pinless type connection to permit rotation of the first hinge plate 28 and the second hinge plate 30 relative to one another.

In the prior art as discussed above, this pivot arrangement freely rotates about the pivot axis P so that the picture frame strut 18 freely moves. In addition to the pinless joint connection, the present invention also optionally provides a structure to control such rotating movement of the strut 18 relative to the picture frame back 20, namely, the movement of the first hinge plate 28 relative to the second hinge plate 30 in a hinge 24. Details of the hinge and its improved connection will be discussed in connection with FIGS. 3–16 below.

Figure 3:
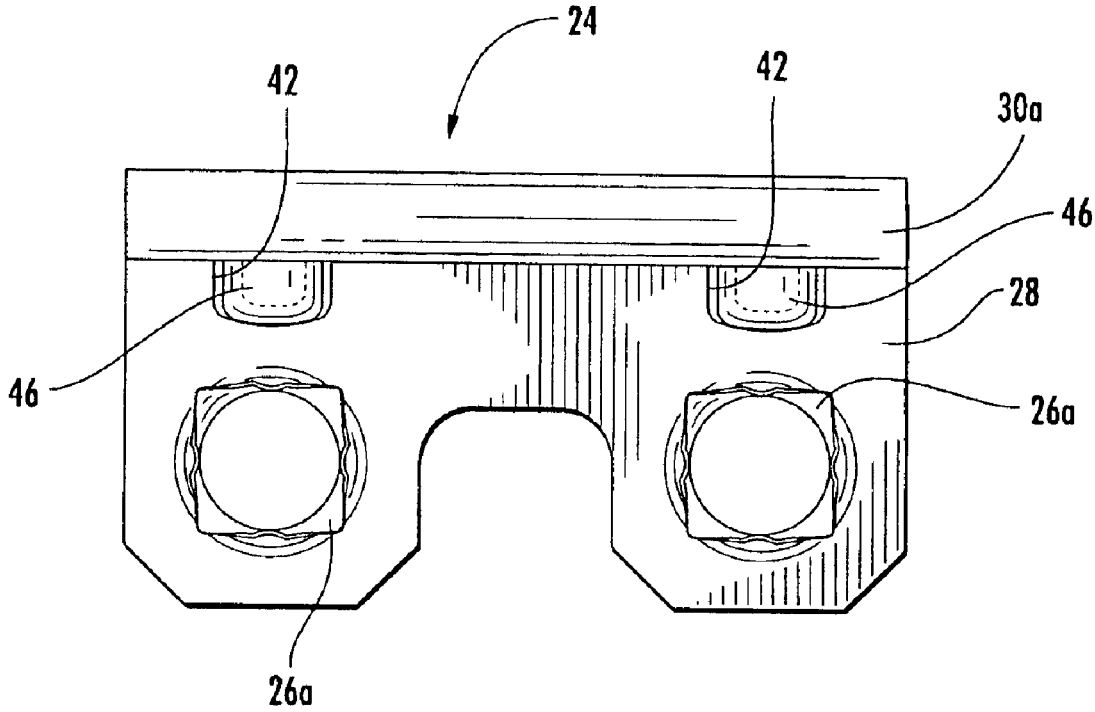
FIG. 3 is a top view of the hinge of the present invention in a closed condition.

Turning next to FIGS. 3–12, the hinge 24 of the present invention is shown in further detail. FIG. 3 shows a top view of the hinge 24 of the present invention where the first hinge plate 28 can be seen with a number of fasteners, namely rosette fasteners 26*a* and 26*b*, to facilitate connection to the picture frame strut 18.

Figure 5:
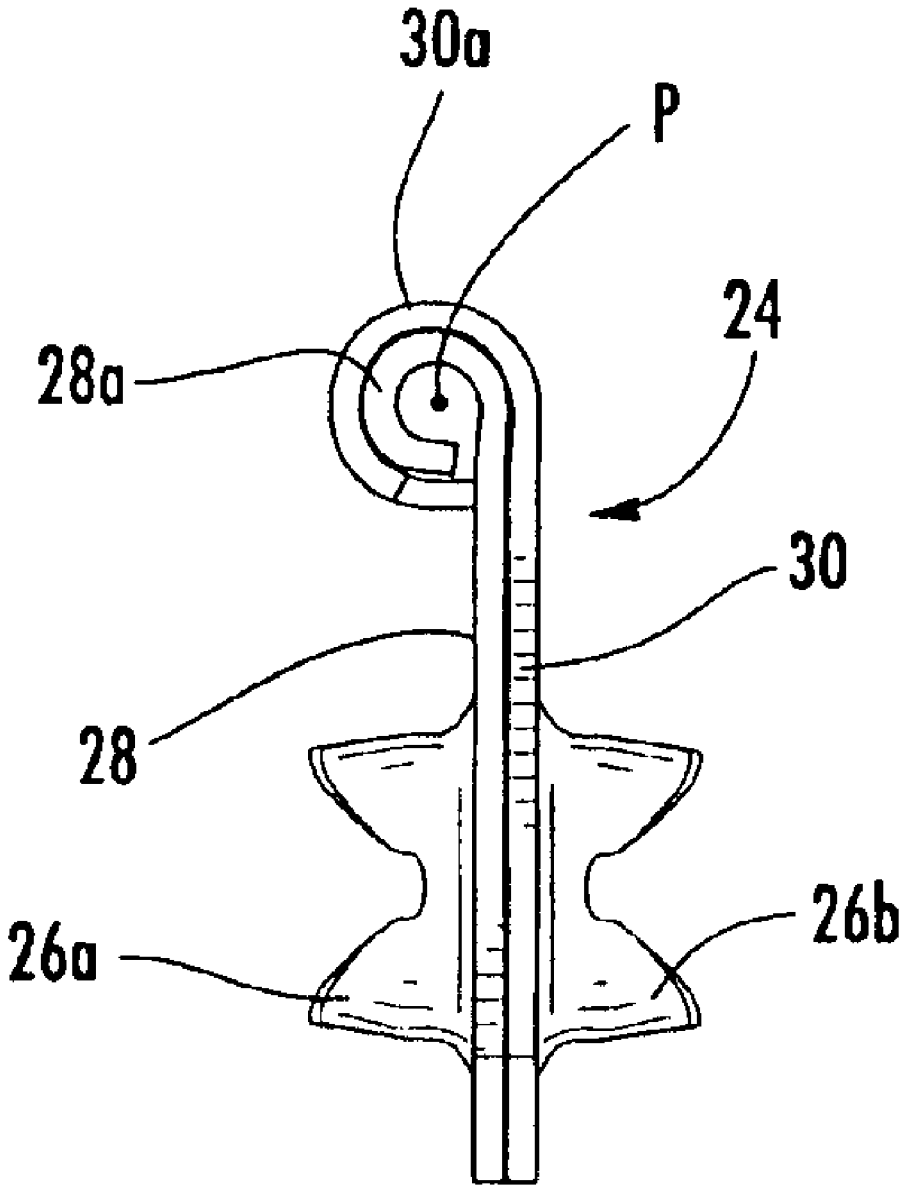
FIG. 5 is a side elevational view of the hinge of FIG. 3 in a closed condition.

Referring to both FIGS. 3 and 5, the rotating connection between the first hinge plate 28 and the second hinge plate 30 is shown in detail. The top edge 28*a* of the first hinge plate 28 is rolled along with the top edge 30*a* of the second hinge plate 30 to form a pivot structure and pivot axis, as can be best seen in FIG. 5. FIG. 5, a right side elevational view of the hinge of FIG. 3, also illustrates a number of fasteners 26*b*, preferably rosette fasteners, on the second hinge plate 30 to facilitate connection to the picture frame back 20. This new pinless pivot connection about P is preferred to simplified and speed up manufacturing of the hinge 24 for mass production. Pass-through apertures 42 in the first hinge plate and the seats 46 on the second hinge plate 30 can also be seen in FIG. 3.

Figure 4:
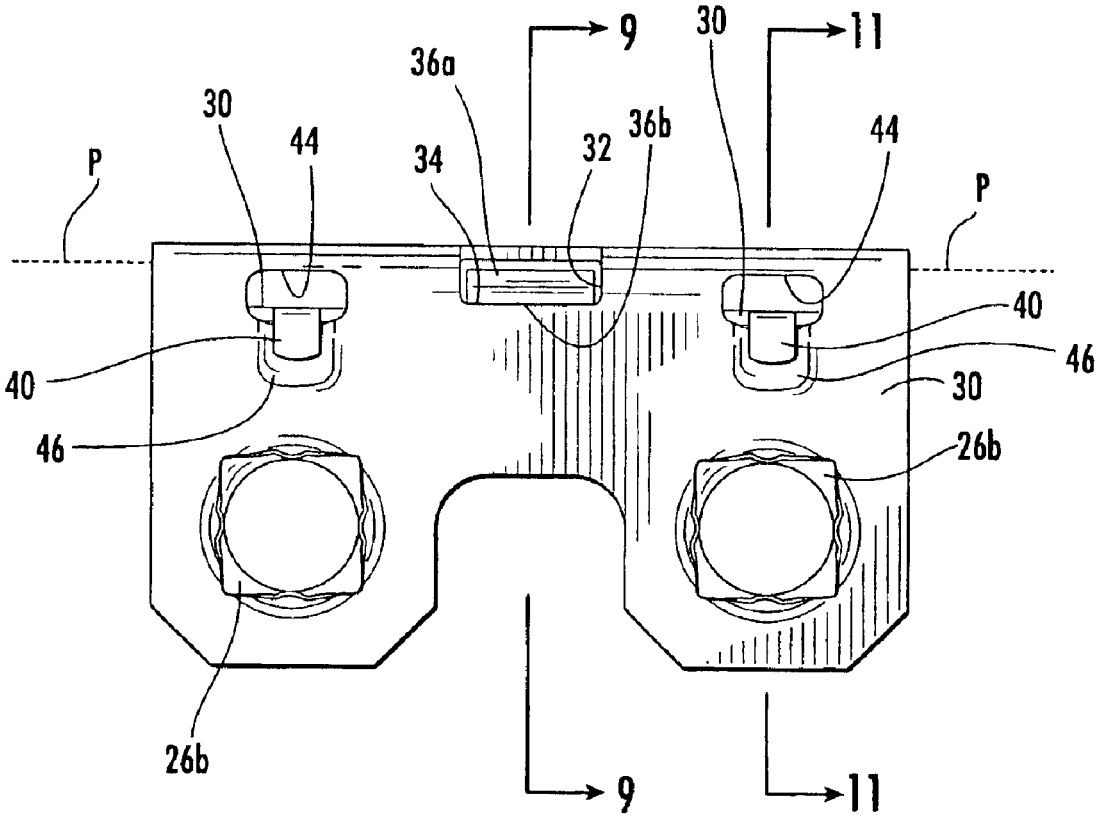
FIG. 4 is a bottom view of the hinge of FIG. 3 in a closed condition.

Turning now to FIG. 4, a bottom view of the hinge 24 of the present invention is shown. The second hinge plate 30 is shown to include its rosette fasteners 26*b* for connection of the hinge 24 to a picture frame back 20. A window aperture 32 is provided through the second hinge plate 30 with a locking edge 34. The window aperture 32 is preferably located near the pivot axis P for ease of manufacturing but may be located any where on the second hinge plate 30. A locking protrusion 36 emanates upwardly from the top edge 28*a* of the first hinge plate 28, as best seen in FIGS. 9 and 10, so it may removably reside in the window aperture 32 of the second hinge plate 30.

The locking construction with protrusion 36 and window 34 as described herein can greatly improve the operation of an easel hinge by controlling the rotation of the first hinge plate 28 relative to the second hinge plate 30. However, this locking mechanism is completely optional and need not be employed in the manufacture of the improved pinless hinge 24 of the present invention. Any type of hinge, with or without a locking mechanism, can take advantage of the improved pinless hinge arrangement disclosed herein.

Figure 9:
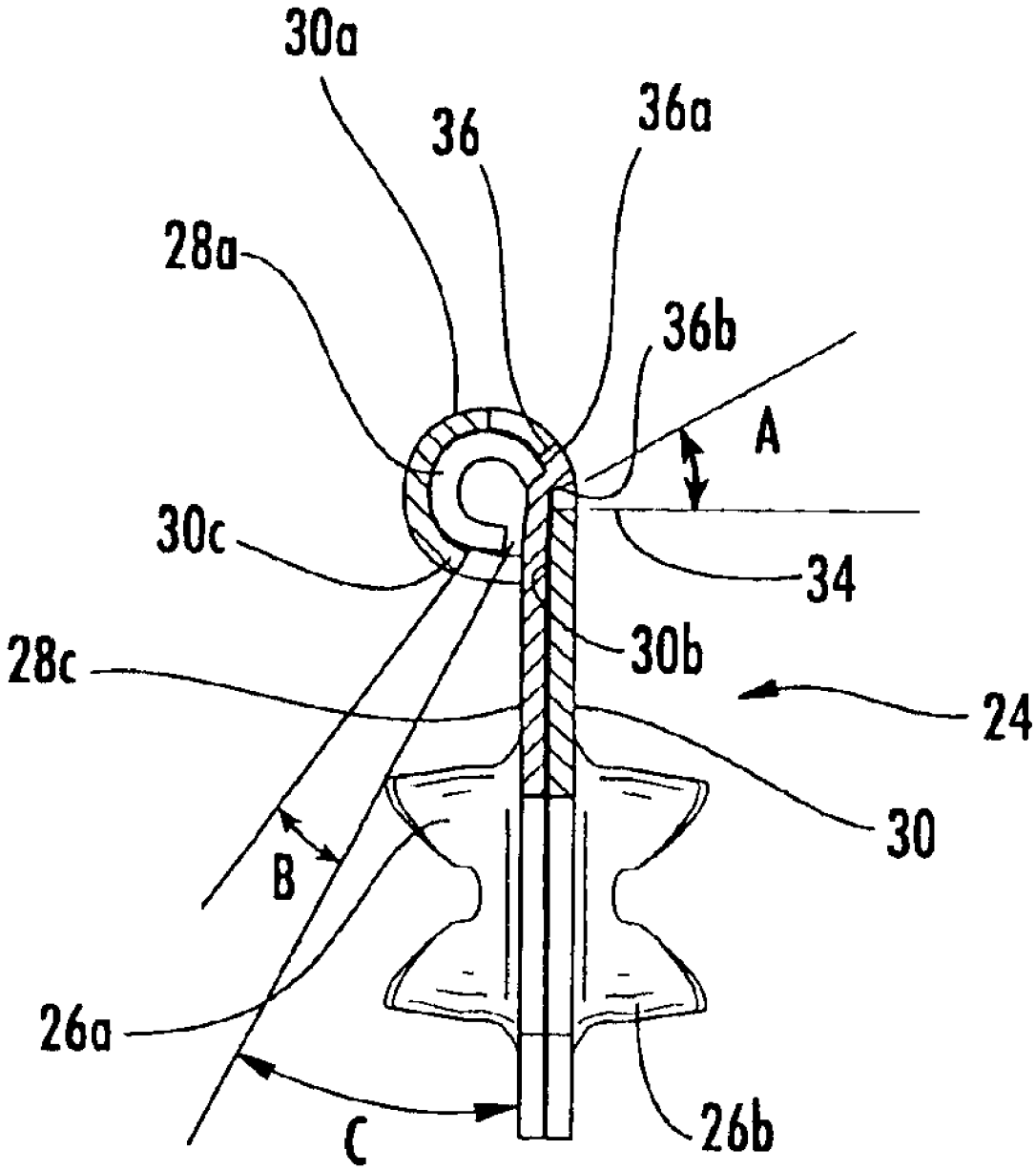
FIG. 9 is a cross-sectional view through the line 9—9 of FIG. 4.
Figure 10:
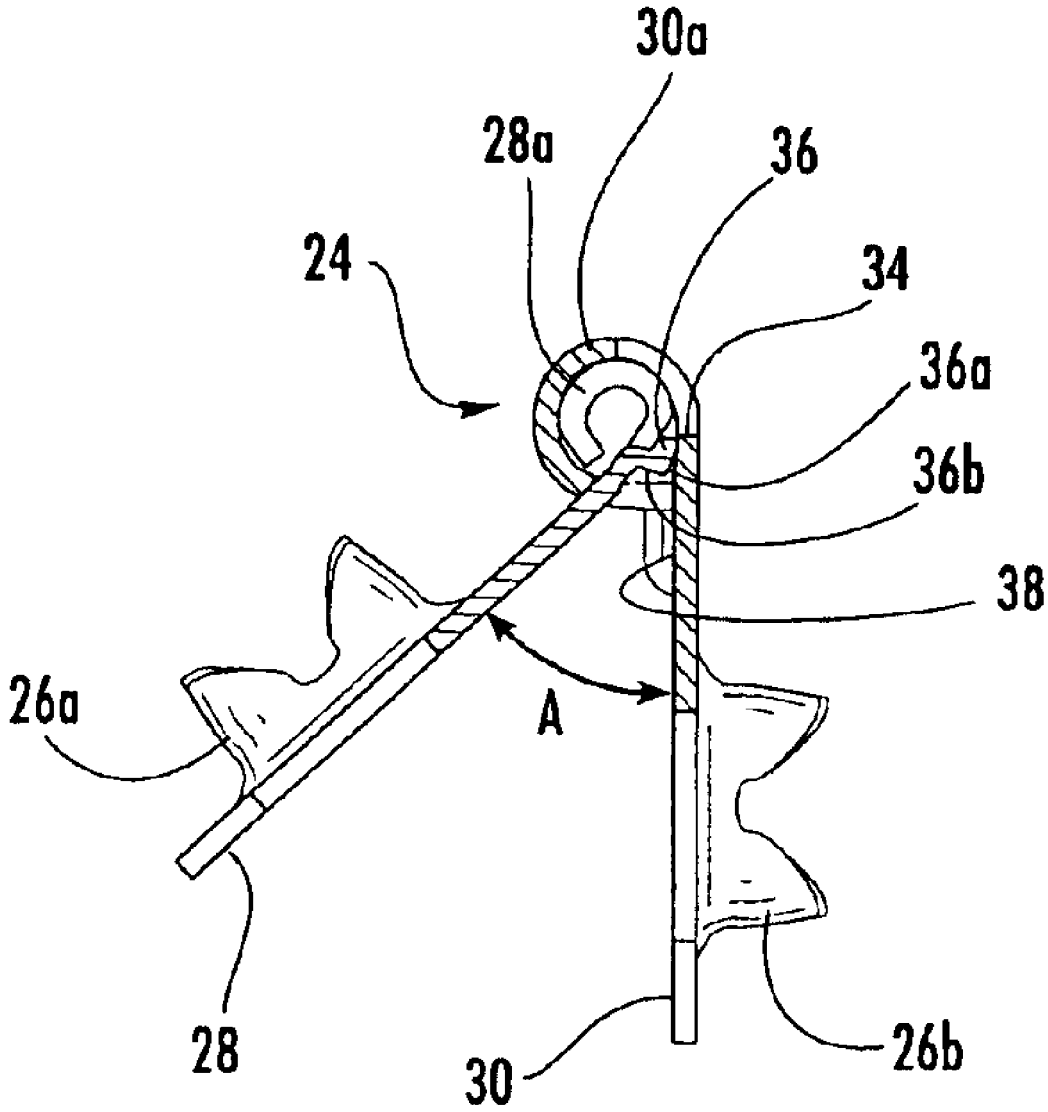
FIG. 10 is a cross-sectional view through the line 10—10 of FIG. 7.

FIGS. 4 and 9 show the positioning of the optional locking protrusion 36 within the window aperture 32 when the hinge 24 is in a closed condition. The protrusion 36 includes a leading contact surface 36*a* and a side contact surface 36*b*. Also, the window aperture 32 in the second hinge plate 30 defines an edge contact surface 34 and a side plate surface 30*b*. In this closed condition, the protrusion 36 residing within the window aperture 32 controls the rotation of the first hinge plate 28 relative to the second hinge plate 30 by the angle defined as "A". Thus, is possible to lift a strut 18 attached to the first hinge plate 28 slightly to get a finger thereunder to assist in pulling it to an open condition, as will be described below. The first hinge plate 28, with strut 18 attached thereto, can be opened to its open condition to an angle represented by angle "B" which is smaller than angle "A".

The protrusion 36 and window aperture 32 arrangement thereby prevents the first hinge plate 28 from being opened all the way to its fully open condition to angle "B". Thus, FIGS. 4 and 9 illustrate the locking of the hinge 24 in a closed condition. In this closed condition, picture frame assembly 10 can be transported and manipulated without concern that the hinge 24 may open causing the picture frame strut 18 to swing open.

When it is desired for the strut 18 to be opened so that the picture frame assembly 10 can be propped up on a shelf, or the like, the strut 18 must be swung open.

Referring back to FIG. 3, a top view of the hinge 24 of the present invention is shown where the aperture 42 in the first hinge plate 28, through the first hinge plate 28, and the seats 46 in the second hinge plate can be seen. Also, In FIG. 4, a bottom view of hinge 24 shows the locking lugs 40 emanating through the aperture 44 through the second hinge plate 30 and bent downwardly to communicate and engage with the seats 46. A front perspective view of the hinge 24 in an open condition can also be seen in FIG. 6. The method of constructing this improved pinless hinge 24 will described below in connection with FIGS. 13–16.

Figure 6:
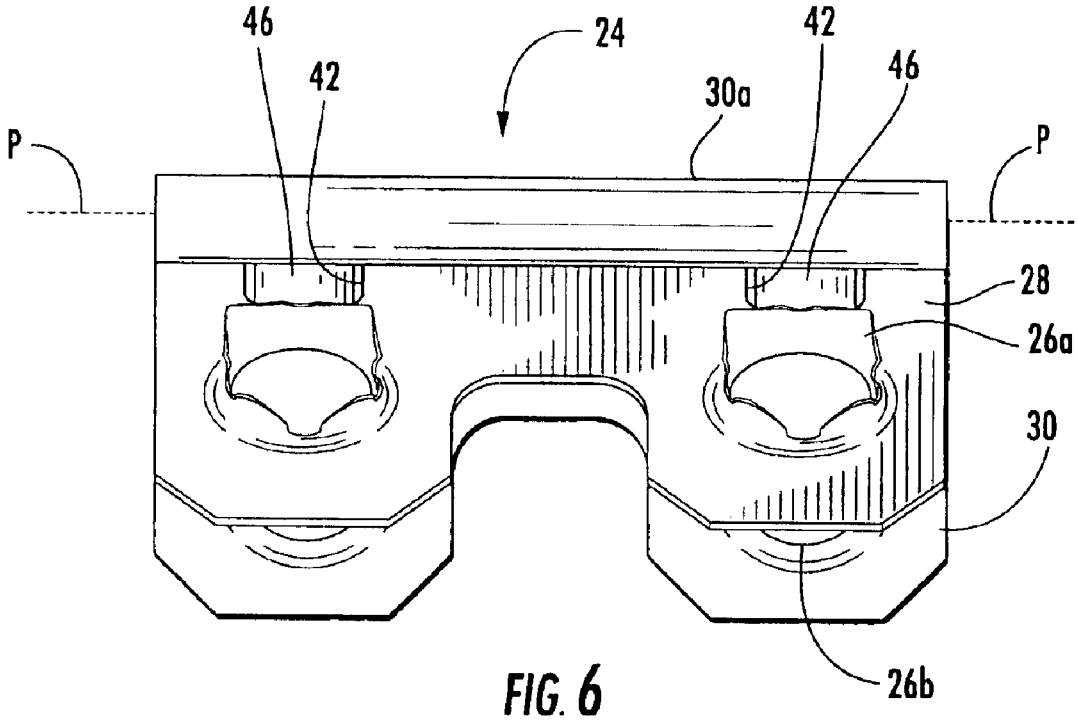
FIG. 6 is a front perspective view of the hinge of FIG. 3 in an open condition.
Figure 7:
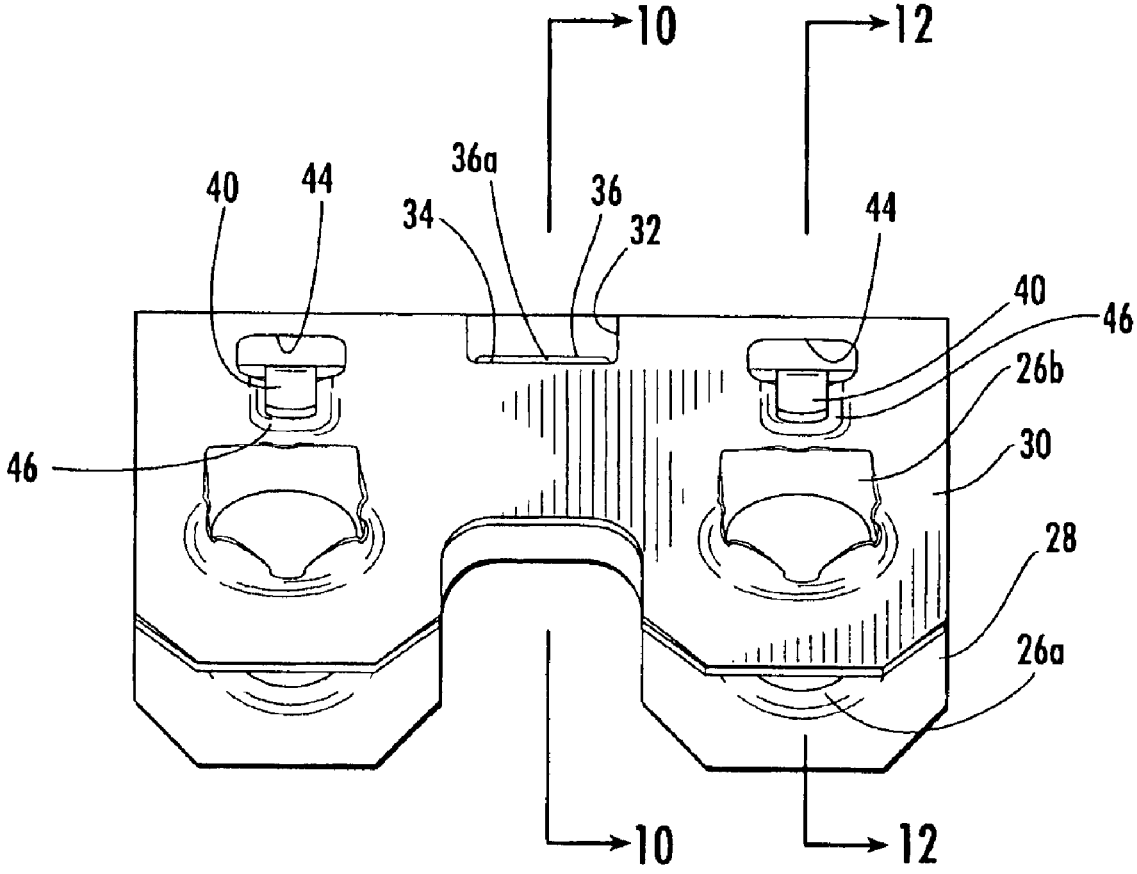
FIG. 7 is a rear perspective view of the hinge of FIG. 3 in an open condition.
Figure 8:
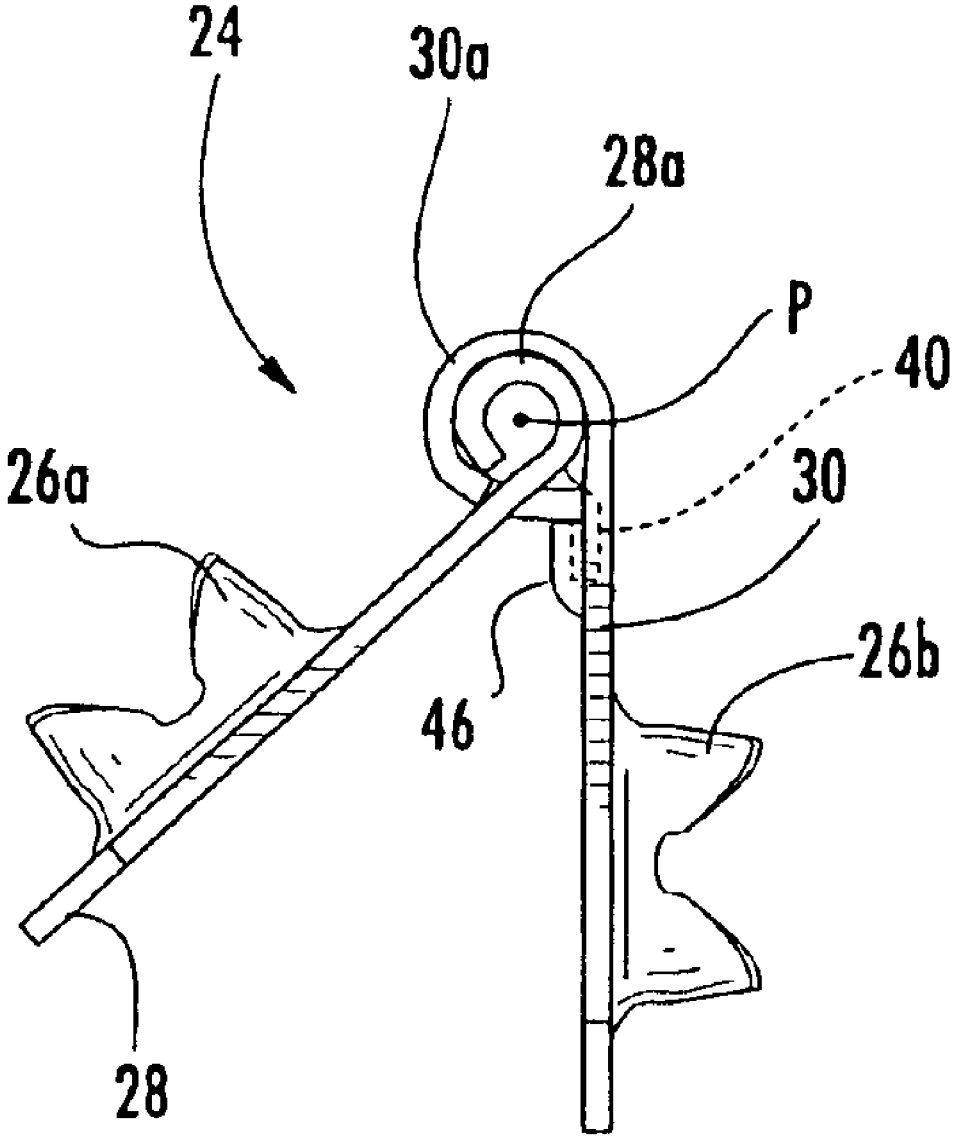
FIG. 8 is a side elevational view of the hinge of FIG. 3 in an open condition.

FIGS. 6–8 and 10 illustrate the hinge 24 of the present invention in the open condition. Turning first to FIG. 6, a top perspective view of the hinge 24 in an open condition is shown with its first hinge plate 28 rotatably connected to the second hinge plate 30. FIG. 7 shows a bottom perspective view of the hinge 24 where locking protrusion 36 is no longer fully residing within the window aperture 32 as in FIG. 4 which shows the hinge 24 in a closed condition. In the FIG. 7, the first hinge plate 28 and the second hinge plate 28 have been rotated relative to one another about the pivot axis P. FIG. 8 shows a side elevational view of the open hinge 24 of the present invention with locking lugs 40 residing in seats 46.

To open the hinge 24 and lock it in an open condition, the first hinge plate 28 is first rotated angle "C", as seen in FIG. 9, about the pivot axis relative to the second hinge plate 30 so that the side contact surface 36*b* of the protrusion is proximal the edge contact surface 34 of the window aperture 32. In this condition, the hinge 24 is only slightly partially open. This will enable the user to place a finger underneath an attached strut 18 to further pull it away from the picture frame back 20. Further pulling of the strut 18 further opens the hinge 24. The leverage from the strut 18 causes the side contact surface 36*b* of the protrusion 36 to ride over the edge contact surface 34 of the window aperture 32 so that the leading contact surface 36*a* of the protrusion 36 communicates with the side plate surface 30*b* just below the window aperture 32. Since causing the protrusion 36 to ride out of the window aperture 32 requires some force, further friction force will remain to maintain the protrusion 36 in frictional communication with the side plate surface 30*b* on the second hinge plate 30 about the window aperture 32 thereby holding the first hinge plate 28 in an open position relative to the second hinge plate 30. This locked open condition can be seen in FIG. 1B. To close the hinge 24, the strut 18 is pressed toward the picture frame back 20 so that the leading contact surface 36*a* of the protrusion 36 rides off of the side plate surface 30*b* of the second hinge plate 30 into the window aperture 32. This closed locked condition is in FIG. 5, as described in detail above.

As can be seen in the figures, the rolled configuration of the free end 30*a* of the second hinge plate 30 is wrapped around the center roll formed at free end 28*a* of the first hinge plate 28. In FIG. 9, it can be seen that the free end 30*c* of top portion 30*a* of second hinge plate 30 is separated enough from the outer side 28*c* of the first hinge plate 28 to permit the first hinge plate to move across angles B and C. Thus, the top portion 30*a* of second hinge plate 30 is only partially rolled about the top rolled portion 28*a* of first hinge plate 28 to permit such pivoting movement of the first hinge plate 28 relative to the second hinge plate 30.

The friction force is set to be large enough so that the locking protrusion 36 is frictionally held in place when in an open locked condition and prevented from opening when in a locked closed condition. The friction force is also set to be small enough so that the forces locking the strut 18 can be easily overcome by hand manipulation of the strut 18 attached to the first hinge plate 28. The amount of force required for locking and the relative angles can be modified to suit the application at hand. For example, the friction force can be increased for hinge use in high vibration environments. In a picture frame environments, large forces are not typically required. With these forces, movement from a closed condition to an open condition typically produces an audible click to indicate to the user that the strut 18 has been successfully locked into its new position.

Figure 11:
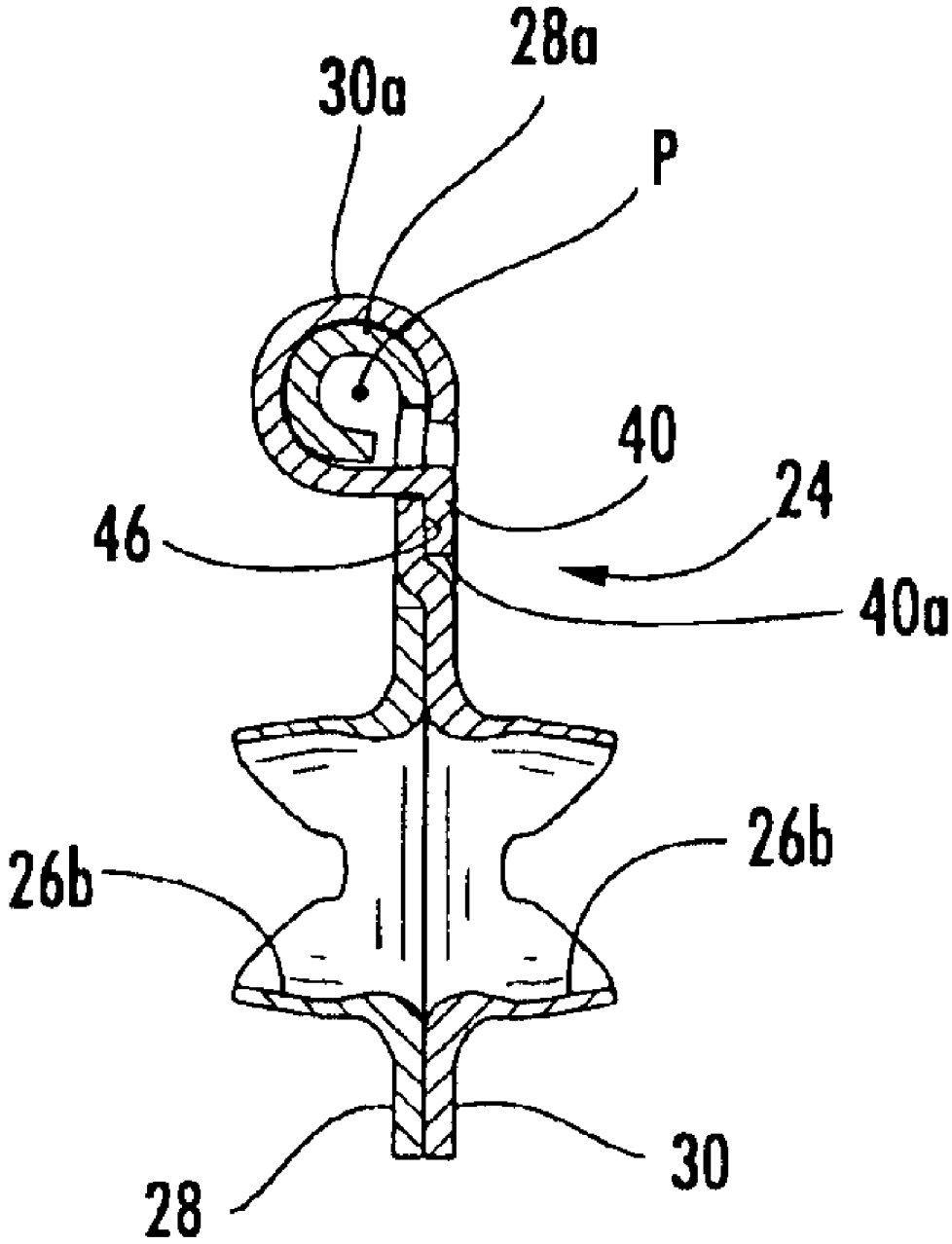
FIG. 11 is a cross-sectional view through the line 11—11 of FIG. 4.
Figure 12:
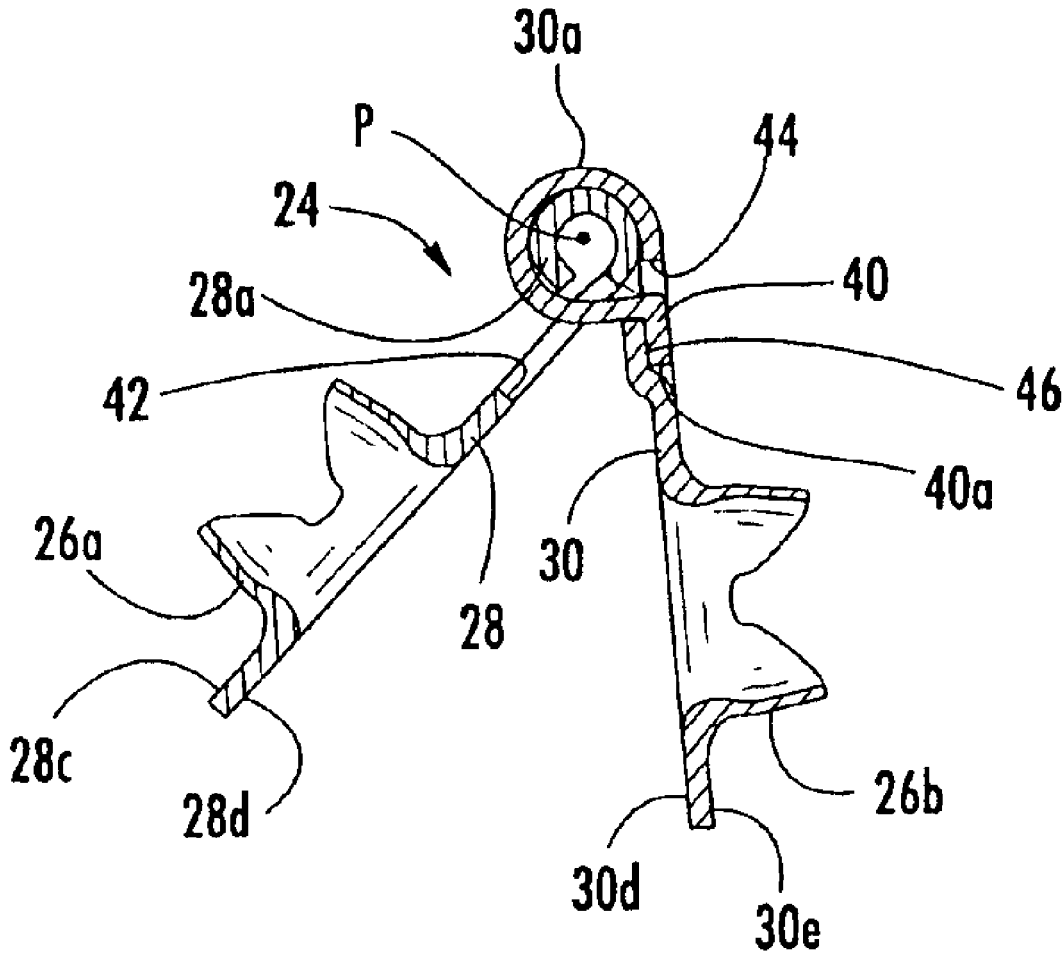
FIG. 12 is a cross-sectional view through the line 12—12 of FIG. 7.

The construction of the pinless hinge 24 of the present invention is further shown in more detail in FIGS. 11 and 12. FIG. 11 shows a cross-sectional view through the line 11—11 of FIG. 4. There is a desire to reduce the weight of hinges. However, thinner stock negatively impacts the integrity of the rolled pivot joint. In these figures, the locking lugs 40 can be clearly seen to reside in seats 46. The top edge 30*a* of the second hinge plate 30 and the top edge 28*a* of the first hinge plate 28 are rolled together. The locking lug 40 extend from the end of the top portion 30*a* of the second hinge plate 30 so that it may pass through respective lug apertures 42 in the first hinge plate 28 and then through lug apertures 44 in the second hinge plate 30. The free ends 42*a* of the locking lug extensions 40 are bent and secured into lug seats 46 on the second hinge plate 30. As result, the rolled top edges 28*a* and 30*a* of the first hinge plate 28 and the second hinge plate 30, respectively, are maintained together. FIG. 12 shows the hinge 24 in an open condition with the locking lugs 40 holding the pinless pivot joint in place.

Essentially, the locking lugs 40 provide a strap-like structure that encircle the hinge joint bundle formed by the curled top end 30*a* of the second hinge plate 30 wrapped about the center roll formed by the curled top end 28*a* of the first hinge plate 28. The free ends 40*a* of the locking lugs 40 are bent into the seats 46 to thereby anchor the free ends 40*a* of the encircling locking lugs 40. Thus, it is extremely difficult to break apart and uncurl the bundled ends 30*a* and 28*a* even if thinner steel gauge stock is used.

Figure 13:
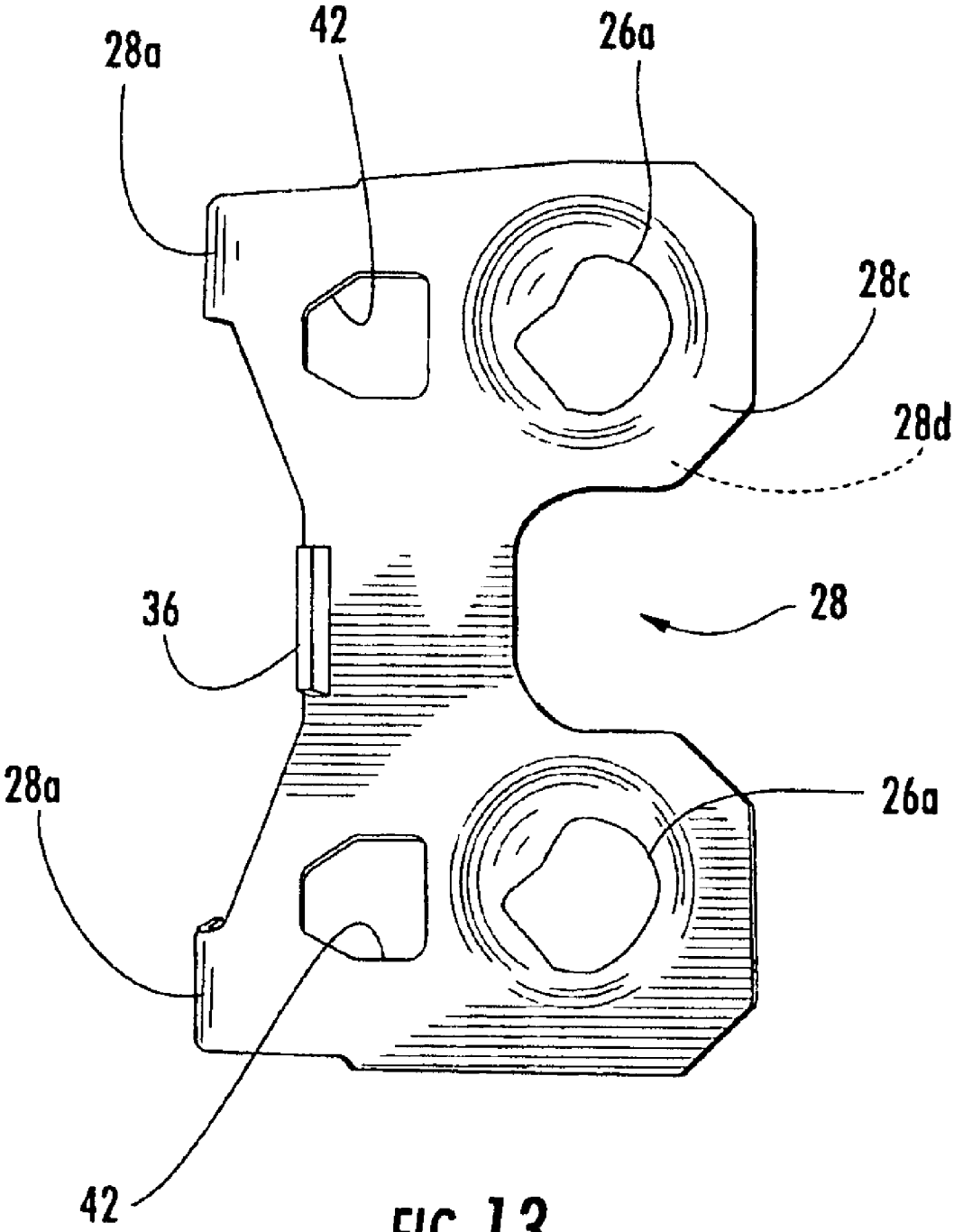
FIG. 13 is a front view of the first hinge plate.
Figure 14:
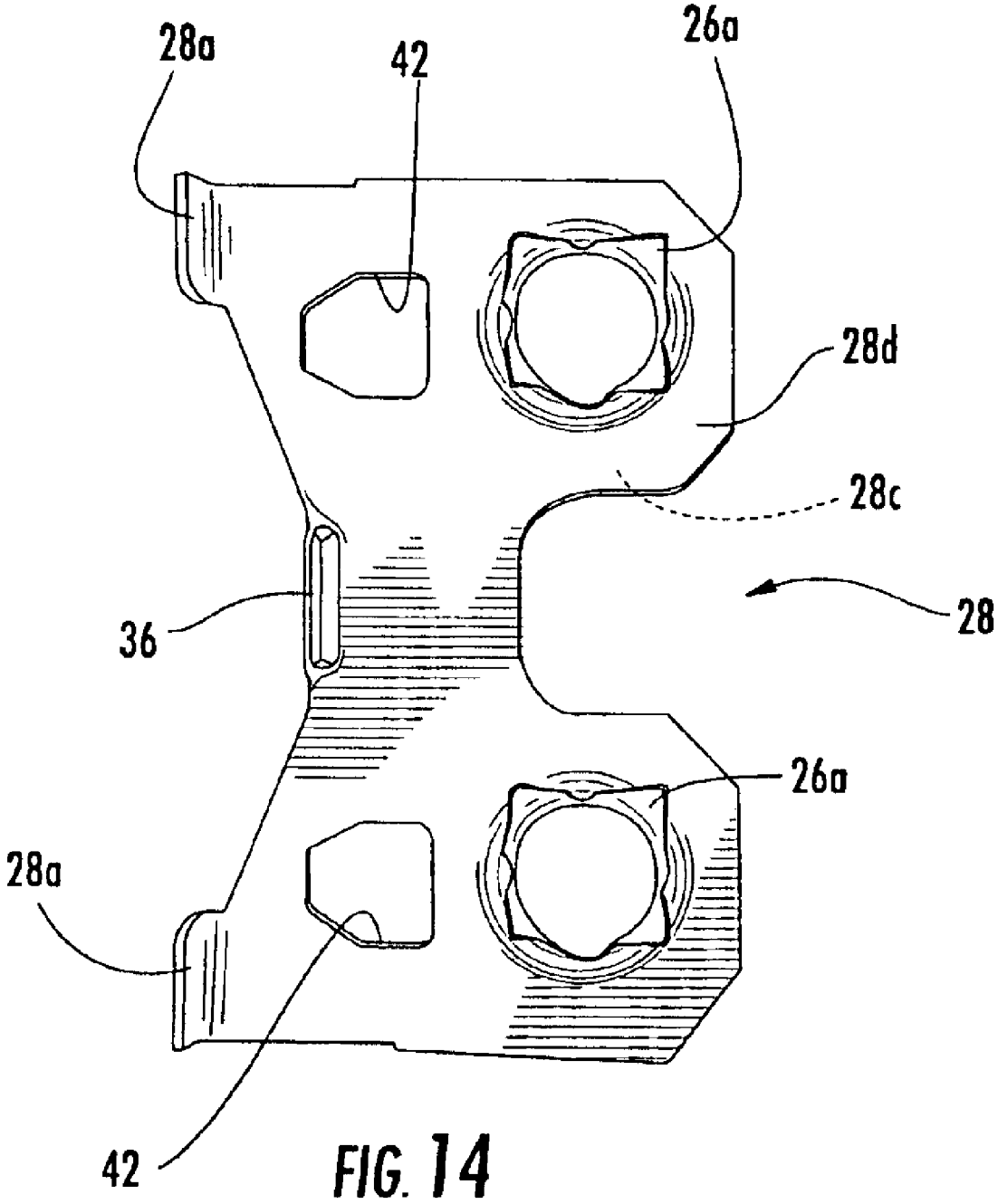
FIG. 14 is a rear view of the first hinge plate of FIG. 13.

The hinge 24 of the present invention is preferably made using progressive tooling to facilitate large scale mass manufacturing. FIGS. 13–16 illustrate the method for manufacturing the hinge 24. FIG. 13 shows a front view of the first hinge plate 28 prior to rolling with inner side 28*c* and outer side 28*d*. FIG. 14 shows a rear view thereof. As can be seen, rosettes fasteners 26*a* are provided for securing the first hinge plate 28 to, for example, a strut 18. The top ends 28*a* are rolled to form a center roll formation, as seen in FIG. 2, for example. The locking member can also be seen in FIGS. 13 and 14.

Figure 15:
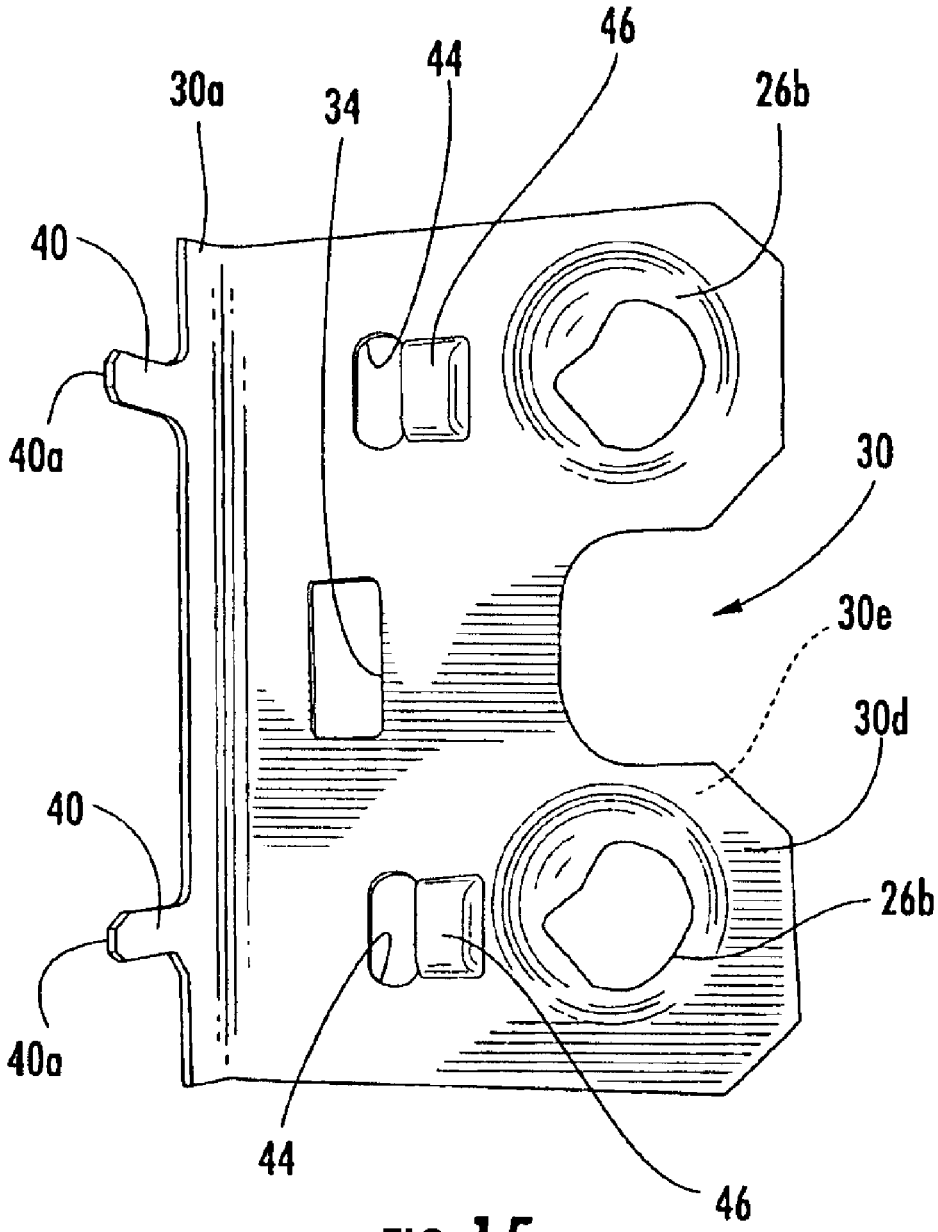
FIG. 15 is a front view of the second hinge plate with locking lugs thereon.
Figure 16:
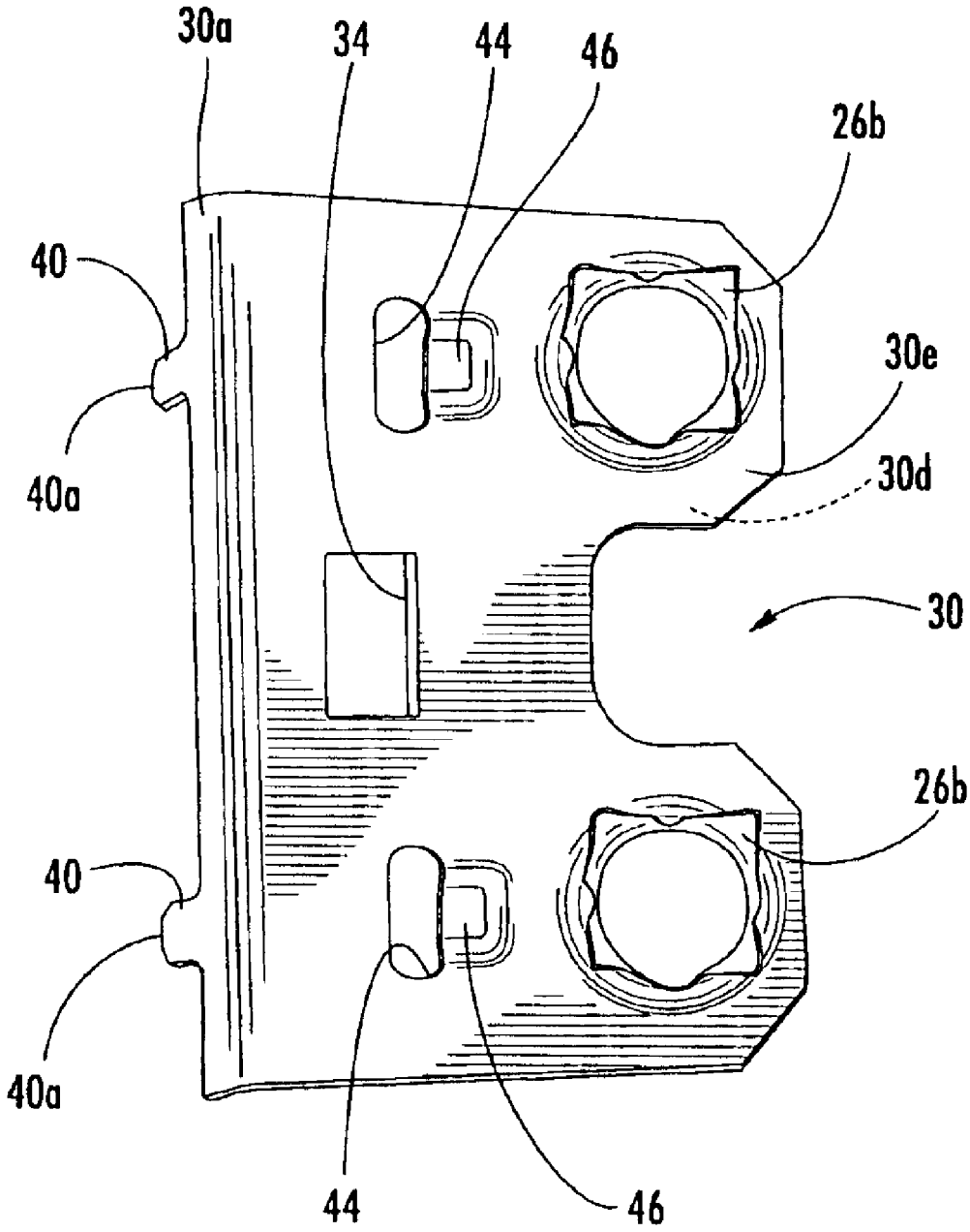
FIG. 16 is a rear view of the second hinge plate of FIG. 15.

A front view of second hinge plate 30 before rolling is shown in FIG. 15 with inner side 30*d* and outer side 30*e*. Rosette fasteners 26*b* are provided for securing the second hinge plate 30 to, for example, a picture frame back 20. The lock aperture 34 can also be seen in FIGS. 15 and 16.

For manufacturing, a progressive tooling method is preferred. Details of the progressive tooling are not shown because such tooling and the techniques relating thereto is generally known in the prior art. In accordance with the present invention, the inner side 28*c* of the first hinge plate is brought into communication with the inner side 30*d* of the second hinge plate 30. The top ends 28*a* of the first plate are rolled with the top end 30*a* of the second hinge plate 30*a*, using the appropriate tooling and anvils, to curl them into a rolled bundle, as can be seen in FIG. 2.

The rolling of places the locking lugs proximal to the apertures 42 in through the first hinge plate 28. Using the appropriate anvils and tooling, the lugs are urged through the apertures 42 and then through the corresponding mating apertures 44 through the second hinge plate 30. Since the first hinge plate 28 and the second hinge plate disposed in communication with each other, it is preferred that the locking lugs are driven through both apertures 42 and 44 in the same step. Further tooling is provided to bend the free ends 40*a* downwardly into flush communication with the seats 46 that can be best seen in FIG. 16. The seats 46 are preferably recessed a distance approximately equal to the thickness of the locking lugs 40 so when the locking lugs 40 reside therein, an aesthetically attractive flush appearance is achieved. The foregoing steps can be carried out as individually or grouped together depending on the tooling used.

Further, the locking lugs 40 can be modified depending on the size of the hinge and desired application. For example, the lugs 40 can be thicker and/or longer depending on the size of the roll formed by the curling of the top edges 28*a* and 30*a*. While it is preferred that a pair of lugs 40 are used for even containment of the hinge joint, it is possible to use only a single lug and corresponding aperture. This may be preferred for very small hinges. More than two locking lugs 40 may be preferred with very large hinges.

It should also be noted that the locking lugs 40 also provides the function of longitudinally keying the first hinge plate 28 relative to the second hinge plate 30. The engagement of the locking lugs 40 within the corresponding apertures 42 and 44 effectively prevents the rolled first hinge plate 29 from sliding along the length of the second hinge plate 30. The locking protrusion 36 and aperture 34 further assists in longitudinal keying, if it is used.

The hinge 24 of the present invention is preferably made of metal, namely steel. For example, steel having of thickness in the range of 0.022 inches can be used in the present hinge 24 instead of stock with thickness in the range of 0.025 inches which would typically used in prior art pinless hinges. This can result, as stated above, a 10% savings in weight can be achieved if such thinner materials are used. Other materials and different dimensions and thickness may be employed and still be within the scope of the present invention.

With the use of the unique bundling of the rolled rotation joint in the hinge in accordance with the present invention, a superior hinge is provided. Conventionally, strength of a hinge joint is improved by simply making the hinge out of thicker stock. The present invention enables a stronger hinge joint to be provided with thinner stock. This is a significant improvement over prior art hinges. A hinge can be achieved that is lighter in weight than prior art hinges without sacrificing hinge quality. The lighter weight reduces the cost of manufacture because less material is used. In addition, the lighter hinges enables more hinges to be packed in a shipping carton thereby reducing the overall shipping costs per hinge. Also, the cost of preparing the surfaces of the easel hinge, such as painting and blackening, are further reduced thereby reducing the overall cost of the hinge.

It would be appreciated by those skilled in the art that various changes and modifications can be made to the illustrated embodiments without departing from the spirit of the present invention. All such modifications and changes are intended to be covered by the appended claims.

What is claimed is:

1. A hinge, comprising, a first hinge plate having a curled edge defining a center roll having a longitudinal axis; the first hinge plate defining a first aperture therethrough; the first hinge plate having an inner side and an outer side;

a second hinge plate having a free edge curled about the center roll; the second hinge defining a second aperture therethrough; the second hinge plate having an inner side and an outer side; the inner side of the second hinge plate substantially facing the inner side of the first hinge plate;

a locking lug, having a free end, connected to the free edge of the second hinge and being routed through the first aperture and the second aperture; the locking lug being engaged with the second hinge plate;

whereby the locking lug maintains the free edge of the second hinge plate curled about the center roll when the first hinge plate rotates relative to the second hinge plate about the longitudinal axis.

2. The hinge of claim 1, wherein the free end of the locking lug is bent into communication with the outer side of the second hinge plate.

3. The hinge of claim 2, further comprising:

a seat in the outer side of the second hinge plate proximal to the second aperture therethrough; and the free end of the locking lug residing in the seat.

4. The hinge of claim 1, further comprising:

means for connecting the first hinge plate to a substrate; and means for connecting the second hinge plate to a substrate.

5. The hinge of claim 4, wherein the means for connecting the first hinge plate to a substrate and the means for connecting the second hinge plate to a substrate are respective rosette fasteners.

6. The hinge of claim 1, wherein the first hinge plate and the second hinge plate are made of metal.

7. The hinge of claim 6, wherein the metal is steel.

8. A hinge, comprising, a first hinge plate having a curled edge defining a center roll having a longitudinal axis; the first hinge plate defining a pair of first apertures therethrough;

the first hinge plate having an inner side and an outer side;

a second hinge plate having a free edge curled about the center roll; the second hinge defining a pair of second apertures therethrough; the second hinge plate having an inner side and an outer side; the inner side of the second hinge plate substantially facing the inner side of the first hinge plate;

a pair of locking lugs, having a free end, connected in spaced apart relation to one another to the free edge of the second hinge and being respectively routed through the pair of first apertures and the pair of second apertures; the locking lugs being engaged with the second hinge plate;

whereby the locking lugs maintain the free edge of the second hinge plate curled about the center roll when the first hinge plate rotates relative to the second hinge plate about the longitudinal axis.

9. The hinge of claim 8, wherein the free ends of the locking lugs are bent into communication with the outer side of the second hinge plate.

10. The hinge of claim 9, further comprising:

a pair of seats in the outer side of the second hinge plate proximal to the pair of second apertures therethrough; and the free ends of the locking lugs respectively residing in the seats.

11. The hinge of claim 8, further comprising:

means for connecting the first hinge plate to a first substrate; and means for connecting the second hinge plate to a first substrate.

12. The hinge of claim 11, wherein the means for connecting the first hinge plate to a first substrate and the means for connecting the second hinge plate to a second substrate are respective rosette fasteners.

13. The hinge of claim 8, wherein the first hinge plate and the second hinge plate are made of metal.

14. The hinge of claim 13, wherein the metal is steel.

15. A method of assembling a hinge, comprising the steps of:

providing a first hinge plate having a free edge and defining a first aperture therethrough; the first hinge plate having an inner side and an outer side;

providing a second hinge plate having a free edge and defining a second aperture therethrough; the second hinge plate having an inner side and an outer side;

providing a locking lug, having a free end, extending from the free edge of the second hinge plate;

placing the inner side of the first hinge plate proximal to the inner side of the second hinge plate;

simultaneously curling the free edge of the first hinge plate and the free end of the second hinge plate;

routing the locking lug through the first aperture;

routing the locking lug through the second aperture;

securing the locking lug to the outer side of the second hinge plate.

16. The method of claim 15, further comprising the steps of:

providing a seat in the outer side of the second hinge plate;

bending the free end of the locking lug into engagement with the seat.

17. The method of claim 15, further comprising the steps of:

providing on the first hinge plate a means for fastening the first hinge plate to a first substrate; and providing on the second hinge plate a means for fastening the second hinge plate to a second substrate.

18. The method of claim 15, wherein the hinge is made of metal.

19. The method of claim 18, wherein the hinge is made of steel.

* * * * *